US008079332B2

(12) United States Patent
Kim et al.

(10) Patent No.: US 8,079,332 B2
(45) Date of Patent: Dec. 20, 2011

(54) CONTINUOUS VARIABLE VALVE LIFT APPARATUS

(75) Inventors: Back Sik Kim, Osan (KR); Ingee Suh, Yongin (KR); Dong Hee Han, Seoul (KR); Wootae Kim, Suwon (KR); Hyung Ick Kim, Gunpo (KR); Myungsik Choi, Seoul (KR); Dae Sung Kim, Hwaseong (KR); Kyoung Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 560 days.

(21) Appl. No.: 12/277,212

(22) Filed: Nov. 24, 2008

(65) Prior Publication Data

US 2009/0183703 A1 Jul. 23, 2009

(30) Foreign Application Priority Data

Jan. 22, 2008 (KR) ..... 10-2008-0006866

(51) Int. Cl.
*F01L 1/34* (2006.01)

(52) U.S. Cl. ..... 123/90.16; 123/90.39

(58) Field of Classification Search ..... 123/90.15, 123/90.16, 90.39

See application file for complete search history.

(56) References Cited

U.S. PATENT DOCUMENTS

2007/0012269 A1 * 1/2007 Schleusener et al. ..... 123/90.16

FOREIGN PATENT DOCUMENTS

JP 2007-40291 A 2/2007
JP 2007-77939 A 3/2007

* cited by examiner

*Primary Examiner* — Zelalem Eshete
(74) *Attorney, Agent, or Firm* — Morgan, Lewis & Bockius LLP

(57) ABSTRACT

The present invention relates to a continuously variable valve lift apparatus that includes an output cam driving unit for transmitting a rotation, an output cam that receives the rotation from the output cam driving unit and rotates about an axis at a predetermined angle, an output cam position controlling unit for controlling the axis of rotation of the output cam, and a valve opening unit that is operated by the output cam.

18 Claims, 11 Drawing Sheets

(a)

(b)

CONTINUOUS VARIABLE VALVE LIFT APPARATUS

CROSS-REFERENCE TO RELATED APPLICATION

This application claims priority to and the benefit of Korean Patent Application No. 10-2008-0006866 filed in the Korean Intellectual Property Office on Jan. 22, 2008, the entire contents of which are incorporated herein for all purposes by this reference.

BACKGROUND OF THE INVENTION

1. Field of the Invention

The present invention relates to a variable valve lift apparatus. More particularly, the present invention relates to a variable valve lift apparatus that is provided with a hydraulic line therein, so that durability and performance may be improved.

2. Description of Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various embodiments of the present invention has been made in an effort to provide a variable valve lift apparatus that may realize various lift operation ranges.

Also, the present invention has been made in part in an effort to provide a variable valve lift apparatus that may be realized with a compact scheme and a small number of elements.

A variable valve lift apparatus according to an exemplary embodiment of the present invention may include an output cam driving unit for transmitting a rotation; an output cam that receives the rotation from the output cam driving unit and rotates about an axis or center at a predetermined angle; an output cam position controlling unit coupled to the output cam and configured to control a position of the rotational axis of the output cam; and a valve opening unit that is operated by the output cam.

The output cam position controlling unit may include: a controlling body; an output cam pivot that is connected to the controlling body and connected with the rotational axis of the output cam; a guide portion guiding the controlling body; and a controlling unit that is connected with the controlling body and controls a position of the controlling body.

The output cam driving unit may include: a first eccentric shaft configured to transmit the rotation to the output cam; and a first connecting link configured to connect the first eccentric shaft with the output cam, wherein the first eccentric shaft is disposed in a first end of the first connecting link and engaged with an inner surface of the first end of the first connecting link. The first eccentric shaft and the first connecting link may be disposed within the output cam.

The output cam driving unit may include: an input cam for transmitting the rotation to the output cam; and an input cam contact roller that is disposed to the output cam and contacts the input cam. The output cam driving unit may further include an output cam elastic portion making restoring force to the output cam toward the input cam to facilitate the input cam to contact the input cam contact roller.

The controlling unit may include: a second eccentric shaft configured to control the position of the controlling body; and a second connecting link connecting the second eccentric shaft with the controlling body, wherein the second eccentric shaft is disposed in a first end of the second connecting link and engaged with an inner surface of the first end of the second connecting link.

The controlling unit may include: a controlling cam for controlling the position of the controlling body; and a controlling cam contact roller that is disposed to the controlling body and contacts the controlling cam. The controlling unit may further include a controlling body elastic portion making restoring force to the controlling body toward the controlling cam to facilitate the controlling cam to constantly contact the controlling cam contact roller.

The guide portion may include a plurality of guide rollers that contacts at least a lateral surface of the controlling body. Diameters of the guide rollers may be different so as to compensate position errors of the rollers.

An upper shape of the valve opening unit that contacts the output cam and the lateral surface of the controlling body that contacts the guide rollers may be concentric circles. The valve opening unit may comprise a swing arm and a swing arm roller. The valve opening unit may comprise a tappet having a crowning upper surface.

The length of diameters of the concentric circles may be infinite. The valve opening unit comprises a swing arm having a flat upper surface. The valve opening unit may comprise a tappet having a flat upper surface.

According to various embodiments of the present invention, a variable valve lift apparatus may be realized with a compact scheme and a small number of elements.

When a valve lift is small according to controlling of pivot of an output cam, opening timing of a valve is advanced.

Controlling of a valve lift may be realized according to a slight design change of the output cam or positions of a controlling body, and a CDA mode may be realized.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
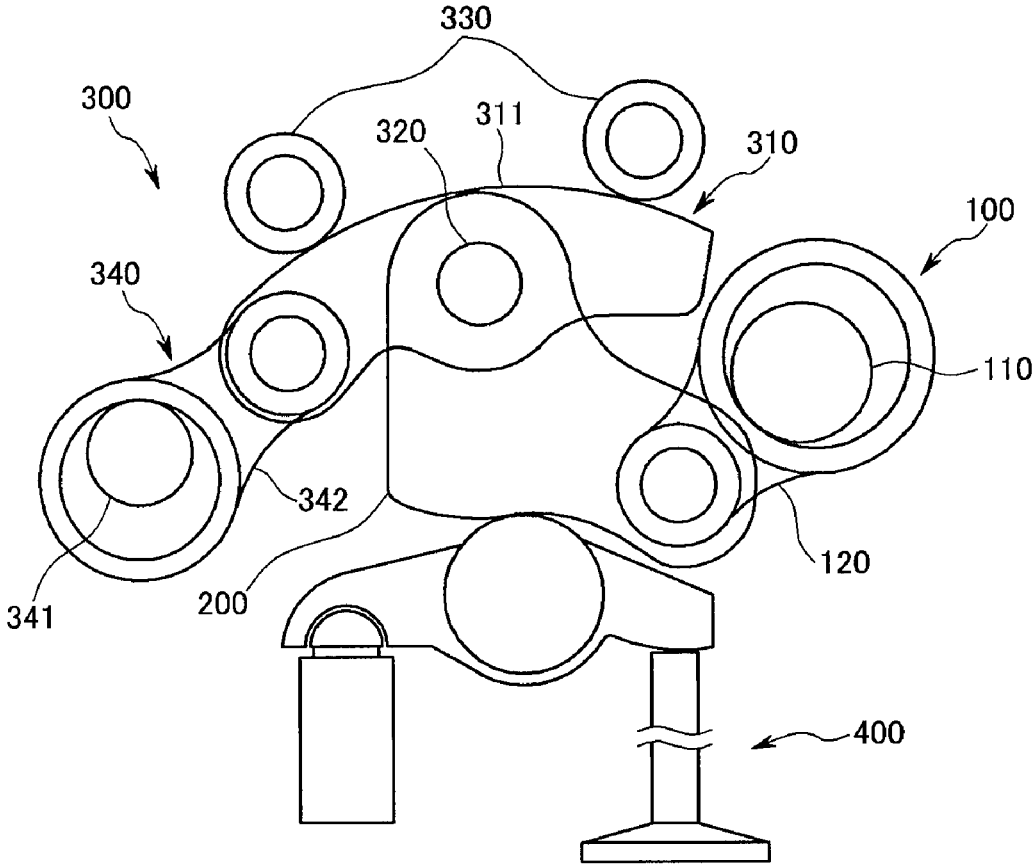
FIG. 1 is a front view of a continuously variable valve lift apparatus according to an embodiment of the present invention.

FIG. 1 is a front view of a continuously variable valve lift apparatus according to the present invention. A continuously variable valve lift apparatus includes an output cam driving unit 100 for transmitting a mechanical rotation of a shaft or the like. The apparatus further includes an output cam 200 that receives the rotation from the output cam driving unit 100 and rotates around a center or rotational axis at a predetermined angle, an output cam position controlling unit 300 for controlling position of a controlling the output cam 200, and a valve opening unit 400 that is operated by the output cam 200.

The output cam position controlling unit 300 includes a controlling body 310, an output cam pivot 320 that is disposed to the controlling body 200 and pivotally connected with the output cam 200 so as to be the axis or center of the rotation of the output cam 200, a guide portion 330 for guiding the controlling body 310 thereon, and a controlling unit 340 that is pivotally connected with the controlling body 310 and controls a position of the controlling body 310.

The guide portion 330 includes a plurality of guide rollers that contact an upper surface 311 of the controlling body 310.

The output cam driving unit 100 includes a first eccentric shaft 110 for transmitting the rotation to the output cam 200 and a first connecting link 120 connecting the first eccentric shaft 110 with the output cam 200. The first eccentric shaft 110 is positioned in a first end of the first connecting link. A second end of the first eccentric shaft 110 is pivotally connected with a first end of the output cam 200. As illustrated in the figures, a portion of the eccentric shaft may be substantially positioned within or surrounded by the first end of the connecting link.

The controlling unit 340 includes a second eccentric shaft 341 disposed for controlling a position of the controlling body 310, and a second connecting link 342 for connecting the second eccentric shaft 341 with the controlling body 310. The second eccentric shaft 341 is positioned in a first end of the second eccentric shaft 341, and a second end of the second eccentric shaft 341 is pivotally connected with a first end of the controlling body 310. The second end of the output cam 200 is rotatably connected substantially with a middle portion of the controlling body 310.

Figure 2:
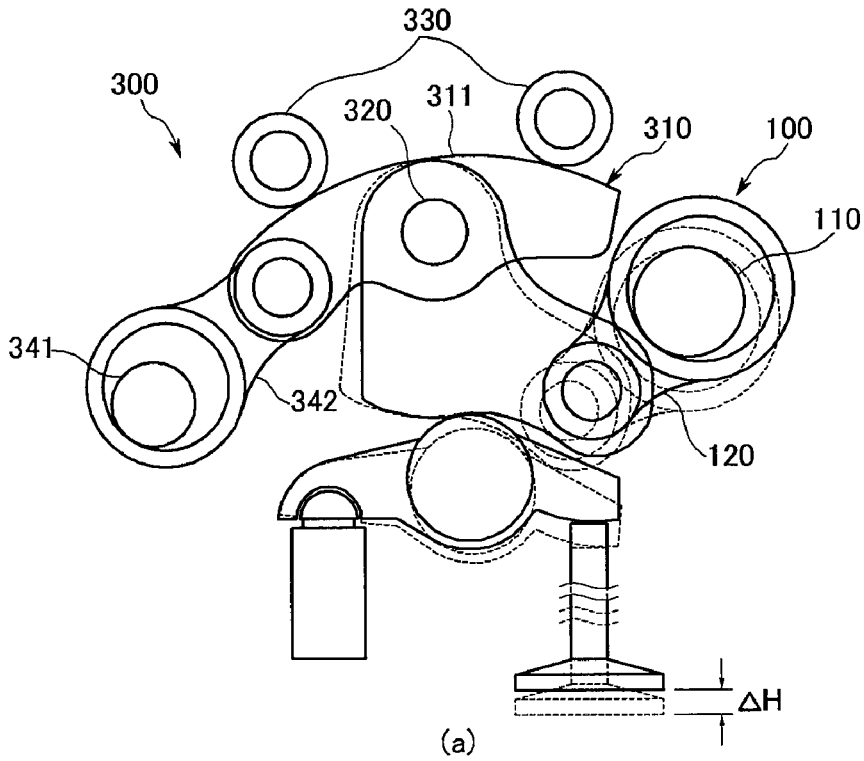
FIG. 2 is showing a high lift mode and a low lift mode of the continuously variable valve lift apparatus according to an embodiment of the present invention.
Figure 2:
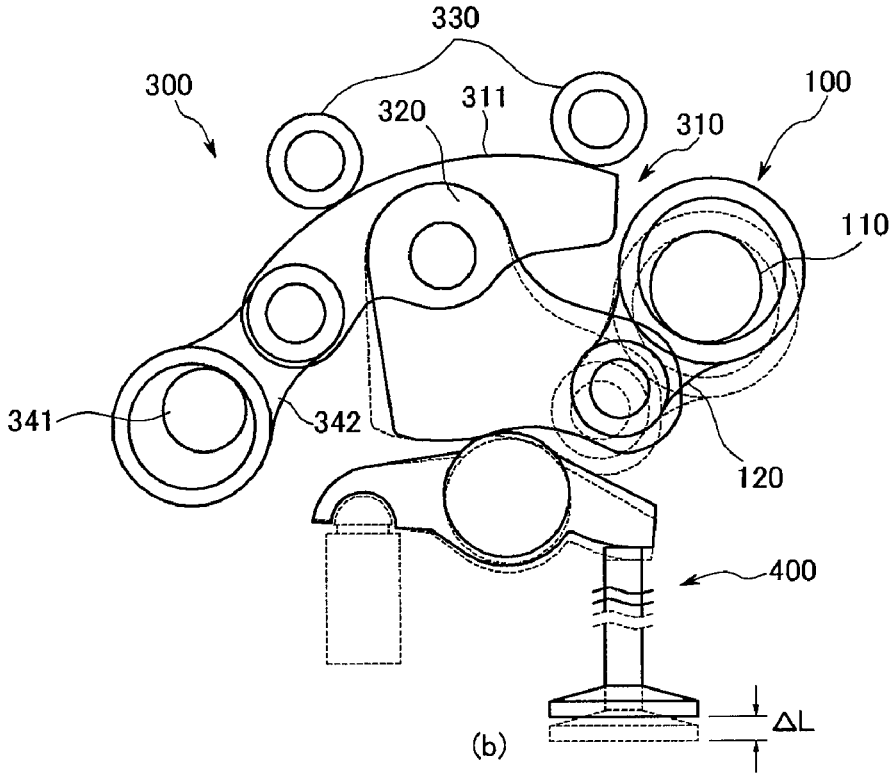

FIG. 2 illustrates a high lift mode and a low lift mode of a continuously variable valve lift apparatus according to various embodiments of the present invention.

Referring to FIG. 2, an operation of the continuously variable valve lift apparatus according to the present invention will be explained. In FIG. 2(*a*), a high lift mode of the continuously variable valve lift apparatus according to the present invention is shown.

In the high lift mode of the continuously variable valve lift apparatus, the controlling body 310 is more distant from the second eccentric shaft 341 by rotation of second eccentric shaft 341. Further, the output cam pivot 320 is relatively more distant from the second eccentric shaft 341. Therefore, a valve lift change $\Delta H$ of the valve opening unit 400 in the high lift mode is relatively large and valve opening timing is also relatively long so as to be suitable for high performance of an engine.

In FIG. 2(*b*), a low lift mode of the continuously variable valve lift apparatus according to the present invention is shown. In the low lift mode, the controlling body 310 is relatively close to the second eccentric shaft 341 by rotation of second eccentric shaft 341. Further, the output cam pivot 320 is relatively close to the second eccentric shaft 341. Therefore, a valve lift change $\Delta L$ of the valve opening unit 400 in the low lift mode is relatively small and valve opening timing is also relatively short so as to be suitable for low performance of an engine.

A portion of the output cam 200 that contacts the valve opening unit 400 may be shaped according to the required performance of an engine including, but not limited to, lift amounts, lift timing, and so on. One skilled in the art will appreciate from the foregoing that the design of the output cam may be further modified in various manner.

Figure 3:
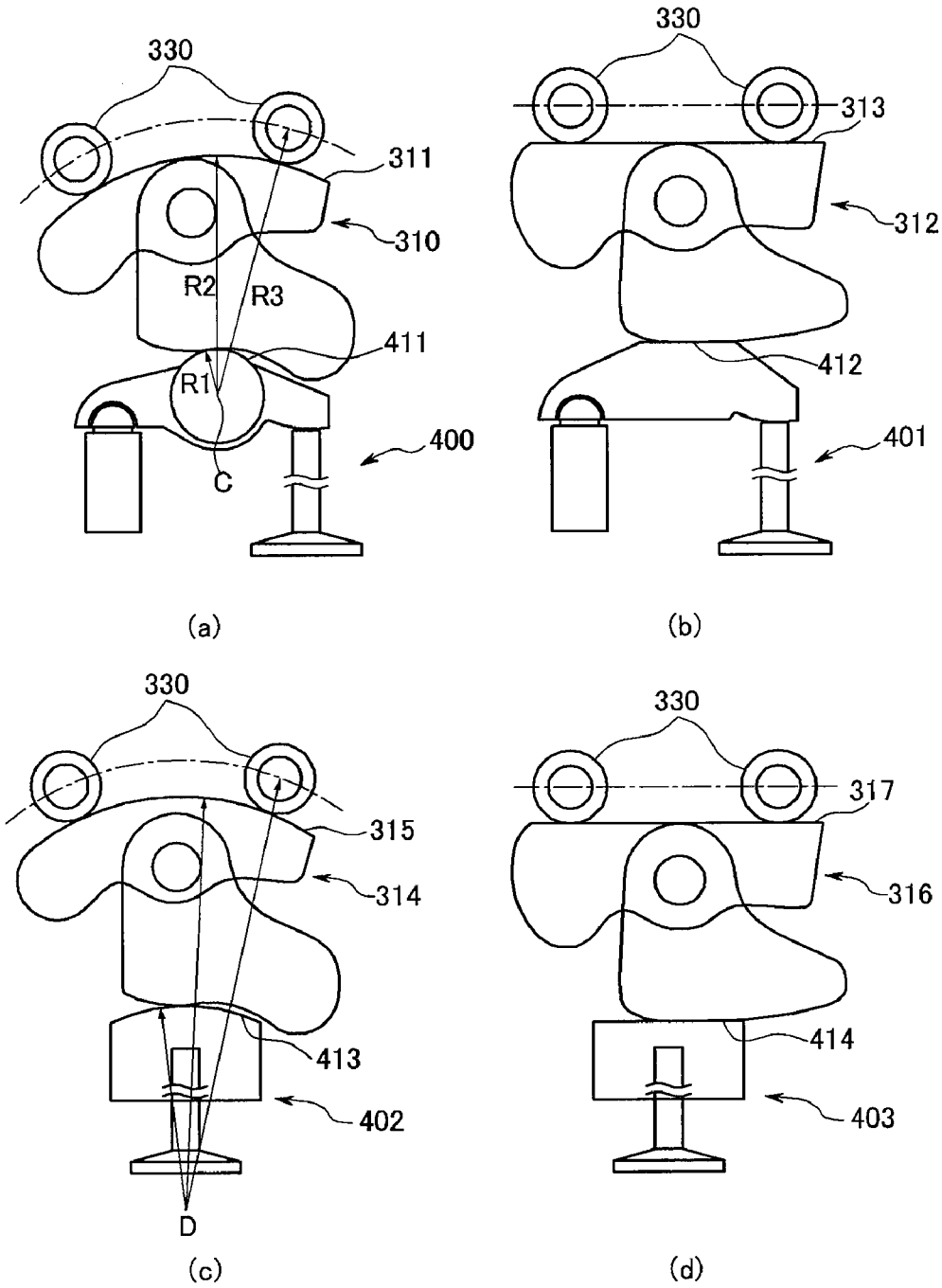
FIG. 3 is an exemplary view of a guide roller and a controlling body according to an embodiment of the present invention.

FIG. 3 is an exemplary view of a guide roller and a controlling body according to the present invention. In FIG. 3(*a*), guide rollers of the guide portion 330 and the controlling body 310 are shown, and "C" indicates a center or axis of a swing arm roller 411.

R1, R2, and R3 indicate radius distances to the swing arm roller 411, the controlling body upper surface 311, and a guide roller 330 from the point "C" respectively and form substantially concentric circles.

If the controlling body 310 moves along the guide roller 330, tolerance can be minimized with the described scheme. That is, lift variation may be constantly maintained so that reliability of engine performance might be enhanced.

FIG. 3(*b*) shows an exemplary variation according to the present invention in which an upper surface 412 of a valve opening unit 401, an upper surface 313 of a controlling body 312, and guide rollers of the guide portion 330 are disposed in parallel.

In the scheme of FIG. 3(*b*), when the controlling body 312 moves along the guide roller 330 disposed in parallel, tolerance that might be induced by the movement of the controlling body 312 can be minimized with the described scheme. It can be assumed that the length of diameters of the concentric circles is infinite.

FIG. 3(*c*) shows another exemplary variation according to the present invention in which a tappet 402 replaces the valve opening unit 400 in FIG. 3(*a*). A tappet upper surface 413, an upper surface 315 of a controlling body 314, and the guide rollers of the guide portion 330 form concentric circles around an arbitrary center D. If the controlling body 314 moves along the guide roller 330 as shown in FIG. 3(*c*), tolerance can be minimized.

FIG. 3(*d*) shows another exemplary variation in which a tappet 403 replaces the valve opening unit 401 in FIG. 3(*b*). A tappet upper surface 414, an upper surface 317 of a controlling body 316, and the guide rollers of the guide portion 330 are disposed in parallel. As explained above, when the controlling body 316 moves along the guide roller 330 disposed in parallel, tolerance that might be induced by the movement of the controlling body 316 can be minimized with the described scheme.

Figure 4:
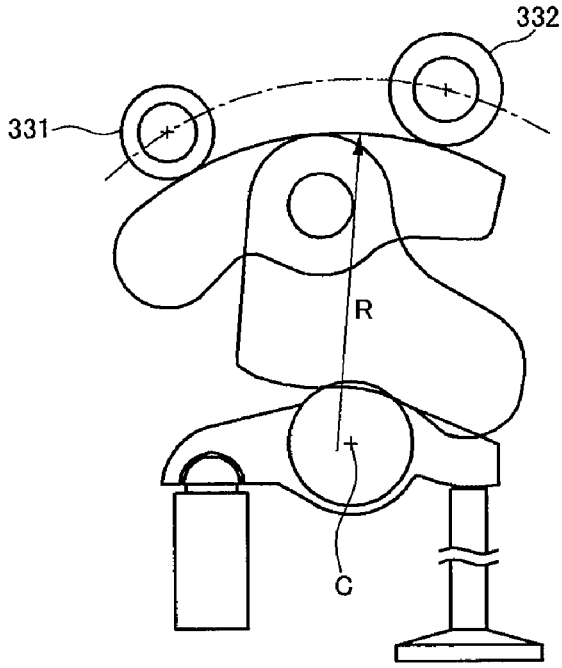
FIG. 4 shows compensatory method according to an embodiment of the present invention.
Figure 4:
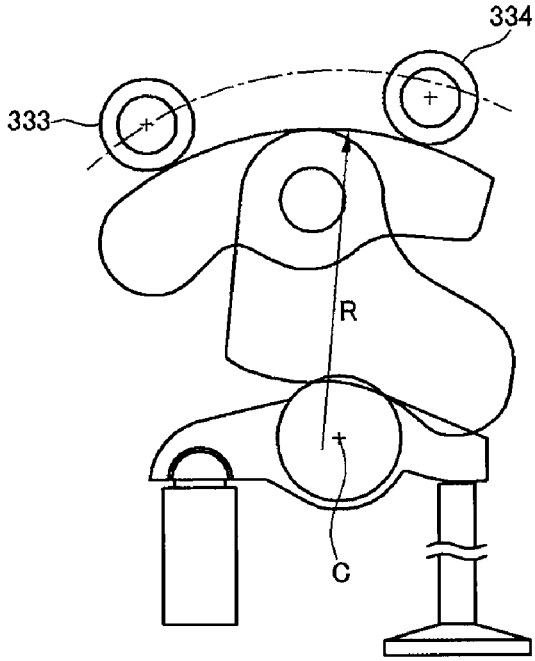

FIG. 4 shows a compensatory method according to various embodiments of the present invention. Positioning errors of a guide roller of the guide portion 330, a controlling body, or a swing arm may be generated in manufacturing processes, and the errors may cause parts to be discarded and cost to increase. However, as shown in FIGS. 4(*a*) and (*b*), size-adjusting of the guide rollers 331 and 332 or position-adjusting of the guide rollers 333 and 334 may remedy errors.

Figure 5:
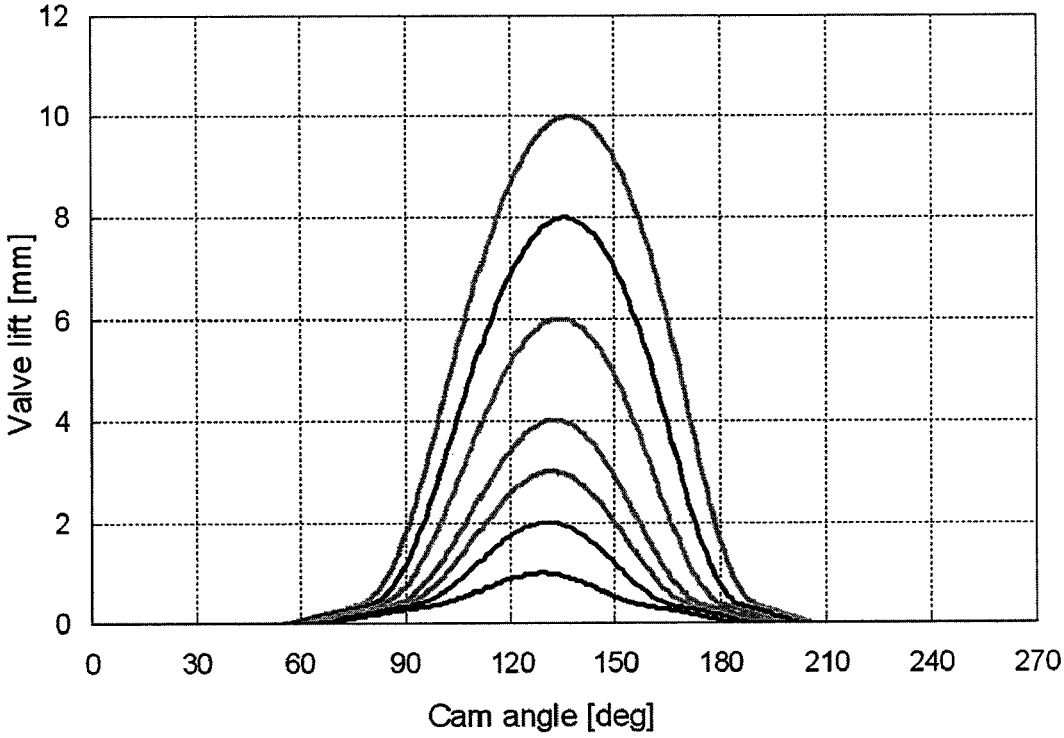
FIG. 5 is a drawing of a valve profile according to an embodiment of the present invention.

FIG. 5 is a drawing of a valve profile according to various embodiments of the present invention.

If the valve lift mode is changed from the high lift mode to the low lift mode as shown in FIG. 5, a peak point of the valve profile in the low lift mode is more advanced than a peak point in the high lift mode.

Figure 6:
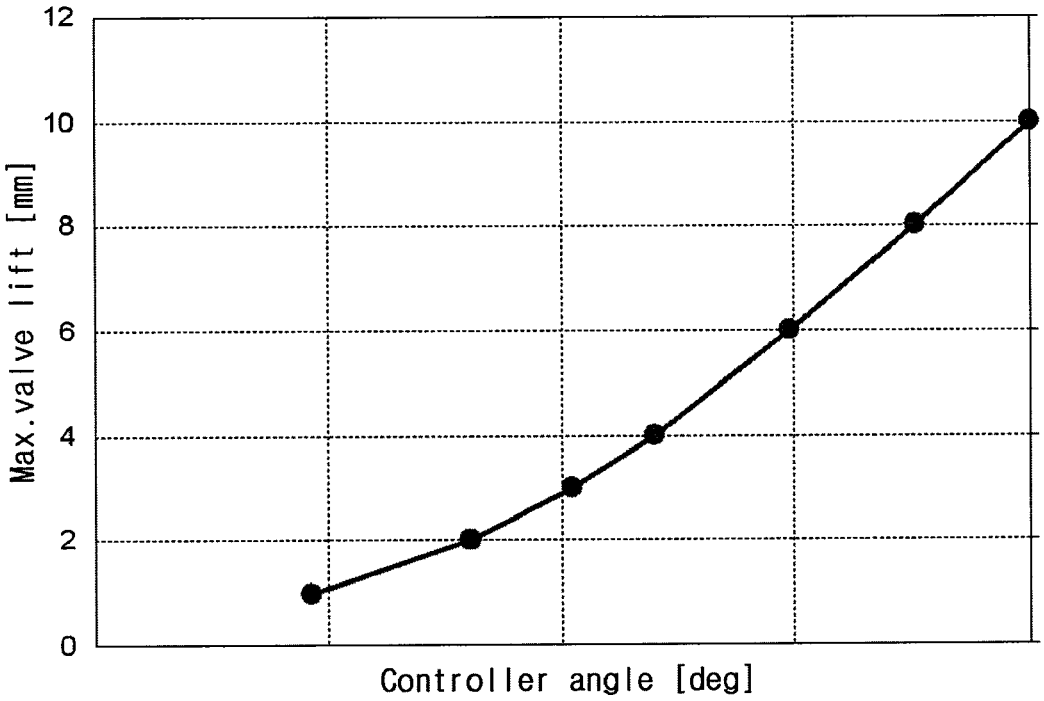
FIG. 6 shows maximum lifts according to controller angles according to an embodiment of the present invention.

FIG. 6 shows maximum lifts according to controller angles in accordance with the present invention.

As shown in FIG. 6, lift variation is small in a small lift range so that valve lift may be easily controlled in a low load range and also an engine may be easily controlled.

Various embodiments of the present invention are illustrated in FIG. 7 to FIG. 11.

Figure 7:
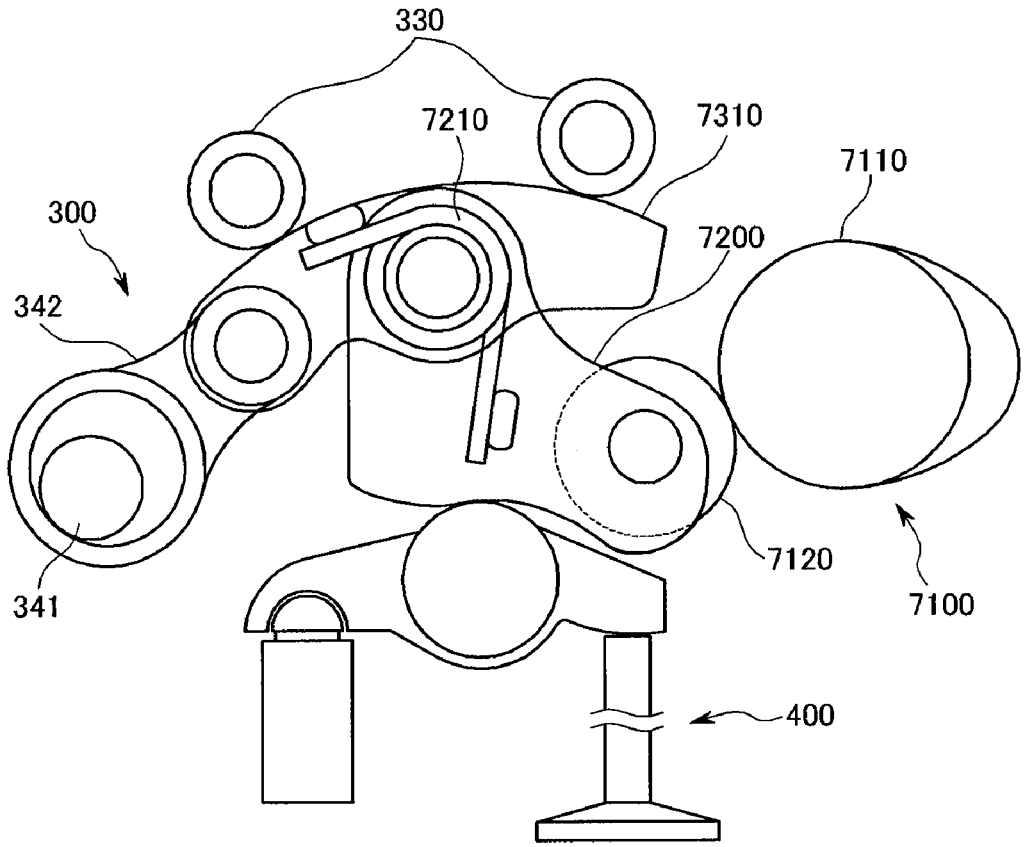
FIG. 7 is a front view of a continuously variable valve lift apparatus according to an embodiment of the present invention.

An output cam driving unit 7100 of a continuously variable valve lift of FIG. 7 includes an input cam 7110 for transmitting rotation to an output cam 7200, an input cam contact roller 7120 that is disposed to a first end of the output cam 7200 and contacts the input cam 7110, and an output cam elastic portion 7210 to facilitate the input cam 7110 to contact the input cam contact roller 7120 when the output cam 7200 is activated by the input cam 7110. The output cam elastic portion 7210 normally brings restoring force toward the input cam 7110.

The output cam driving unit 7100 uses the input cam 7110 that is similar to a conventional cam so that only a slight design change of a conventional valve train is needed, and production cost may be reduced.

Other elements of the continuously variable valve lift apparatus according to the present invention are similar to the above, so repeated explanation will be omitted.

Figure 8:
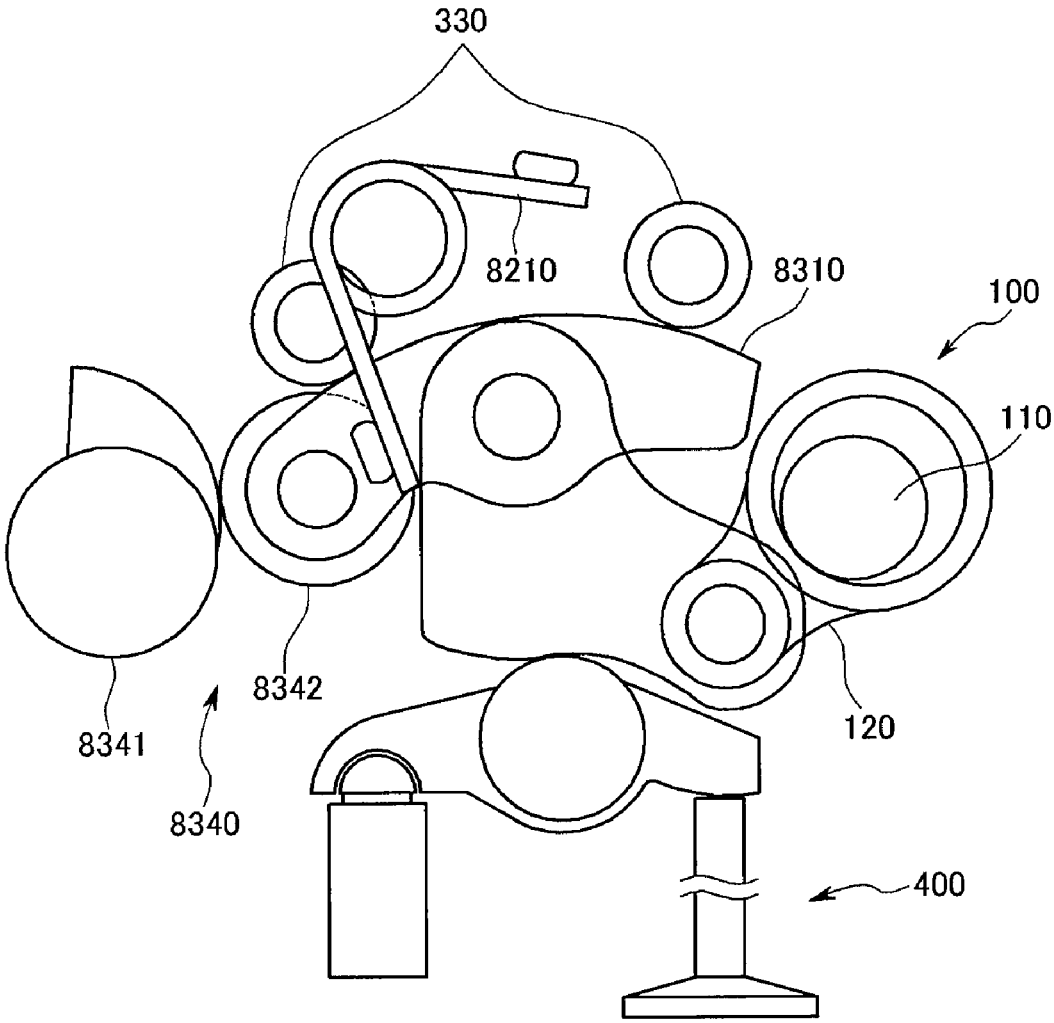
FIG. 8 is a front view of a continuously variable valve lift apparatus according to an embodiment of the present invention.

A controlling unit 8340 of the continuously variable valve lift apparatus of FIG. 8 includes a controlling cam 8341 for controlling a position of a controlling body 8310, a controlling cam contact roller 8342 that is disposed to a first end of the controlling body 8310 and contacts the controlling cam 8341, and a controlling body elastic portion 8210 to facilitate the controlling cam 8341 to constantly contact the controlling cam contact roller 8342. The controlling cam contact portion 8210 normally makes restoring force toward the controlling cam 8341.

Other elements of the continuously variable valve lift apparatus are similar to the above, so repeated explanations will be omitted.

Figure 9:
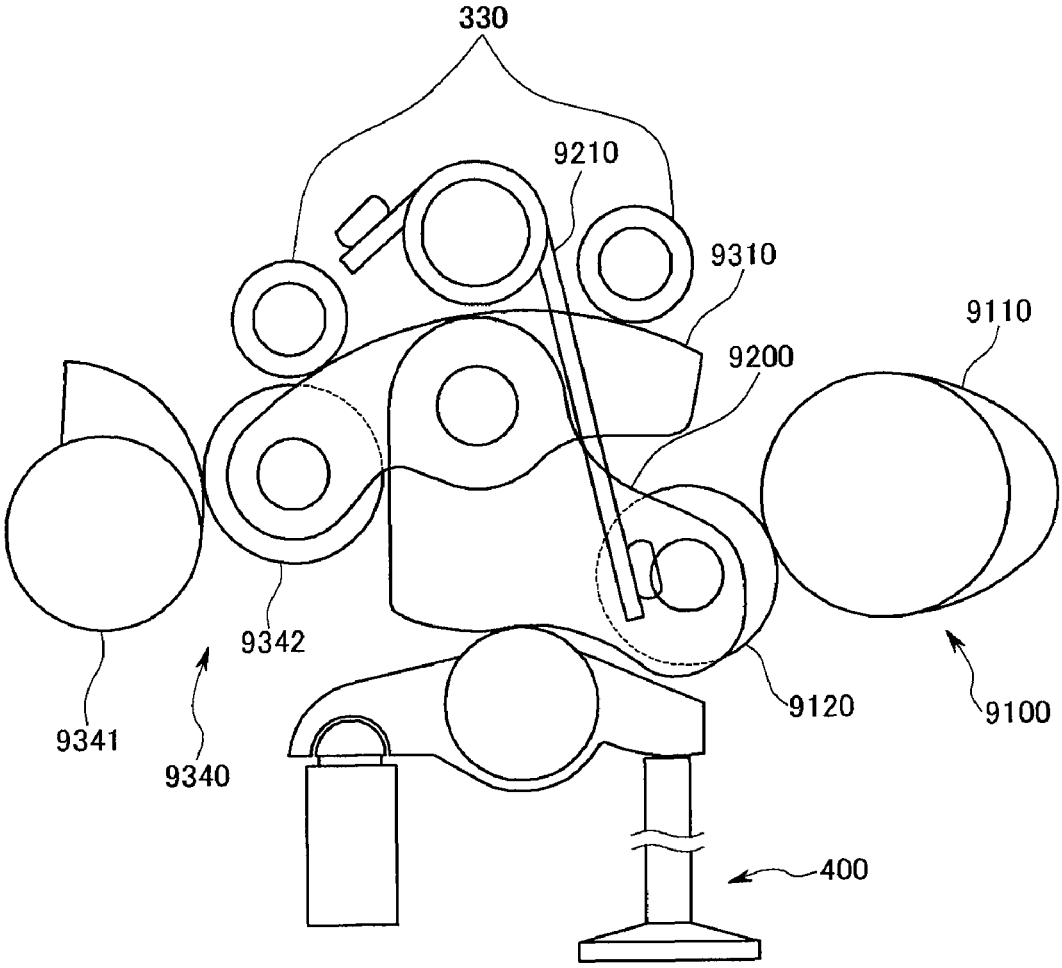
FIG. 9 is a front view of a continuously variable valve lift apparatus according to an embodiment of the present invention.

An output cam driving unit 9100 of the continuously variable valve lift of FIG. 9 includes an input cam 9110 for transmitting the rotation to an output cam 9200, and an input cam contact roller 9120 that is disposed to the output cam 9200 and contacts the input cam 9110.

A controlling unit 9340 includes a controlling cam 9341 for controlling a position of the controlling body 9310, and a controlling cam contact roller 9342 that is disposed to a first end of a controlling body 9310 and contacts the controlling cam 9341.

An output cam elastic portion to facilitate the input cam contacting the input cam contact roller may be provided. A controlling body elastic portion for the controlling cam to constantly contact the controlling cam contact roller may also be provided. However, as shown in FIG. 9, one output cam elastic portion 9210 may be provided to act as an output cam elastic portion and a controlling body elastic portion so that the number of elements may be reduced.

Other elements of the continuously variable valve lift apparatus are similar to the above, so repeated explanation will be omitted.

Figure 10:
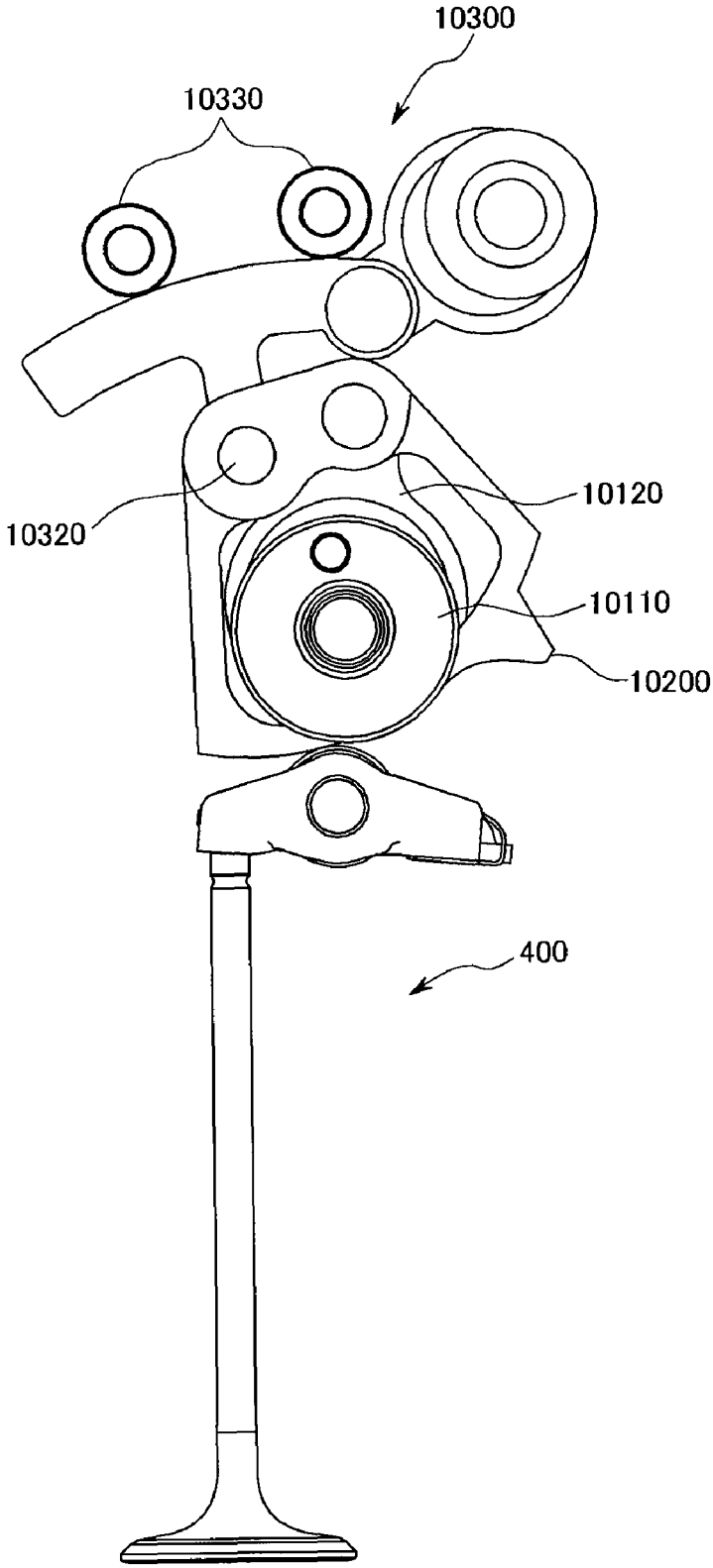
FIG. 10 is a front view of a continuously variable valve lift apparatus according to an embodiment of the present invention.
Figure 11:
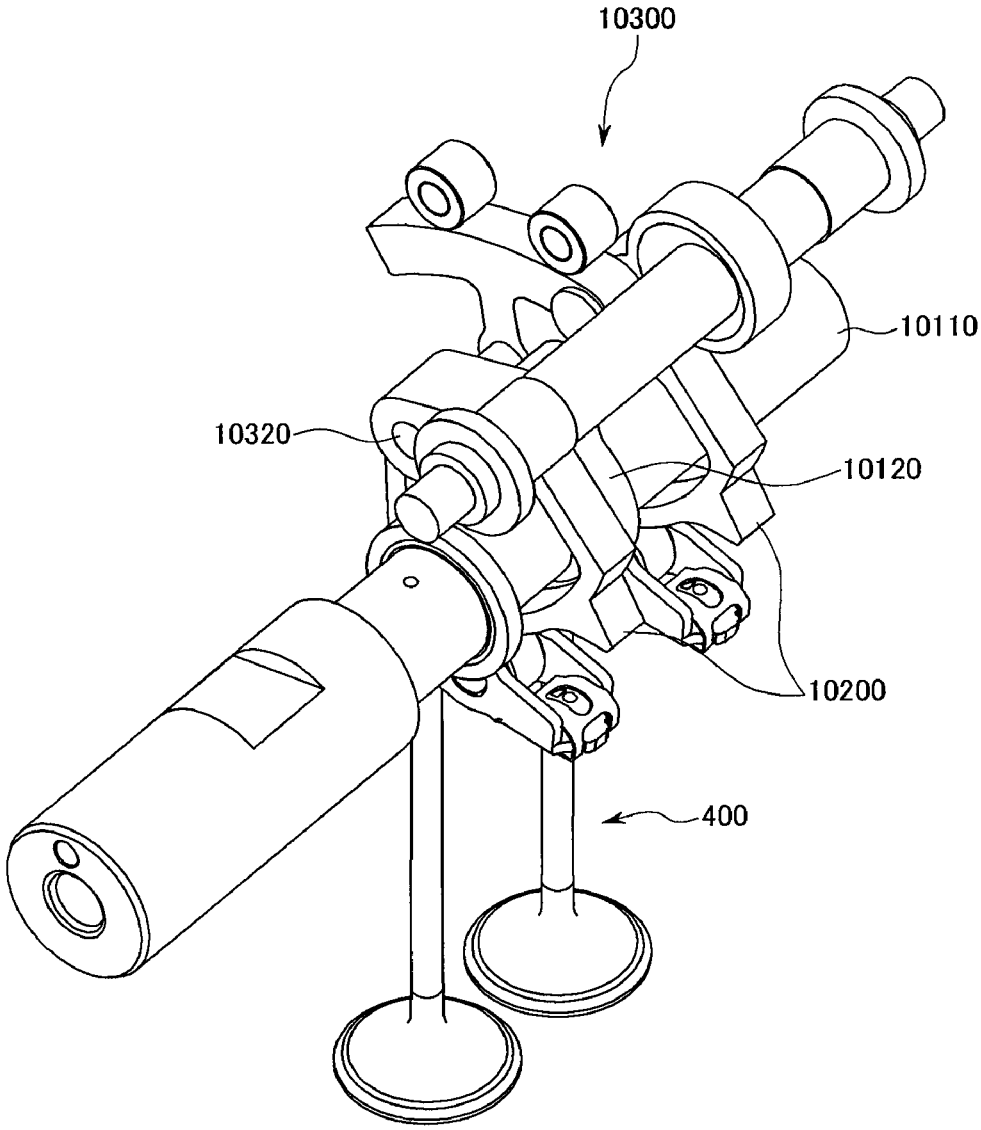
FIG. 11 is a side view of a continuously variable valve lift apparatus according to an embodiment of the present invention.

FIG. 10 and FIG. 11 are a front view and a side view of a continuously variable valve lift apparatus according to various embodiments of the present invention.

In the continuously variable valve lift apparatus of FIGS. 10-11, a first eccentric shaft 10110 for transmitting rotation and a first connecting link 10120 connected with the first eccentric shaft 10110 are disposed within an output cam 10200.

The output cam 10200 rotates around an output cam pivot 10320, and a position of the output cam pivot 10320 is adjusted by an output cam position controlling unit 10300 along the guide portion 10330.

Other elements of the continuously variable valve lift apparatus are similar to the above, so repeated explanation will be omitted.

According to the exemplary embodiment of FIGS. 10-11, the continuously variable valve lift apparatus may be realized with a slight design change of a conventional valve train so that mass production is possible without bearing significant expenses.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. Continuously variable valve lift apparatus comprising:

an output cam driving unit for transmitting a rotation;

an output cam that receives the rotation from the output cam driving unit and rotates about an axis at a predetermined angle;

an output cam position controlling unit coupled to the output cam and configured to control a position of the axis of the output cam; and a valve opening unit that is operated by the output cam;

wherein the output cam position controlling unit comprises:

a controlling body;

an output cam pivot that is disposed on the controlling body and connected with the output cam so as to form the axis of the output cam;

a guide portion for guiding the controlling body; and a controlling unit that is connected with the controlling body and controls a position of the controlling body.

2. The continuously variable valve lift apparatus of claim 1, wherein the output cam driving unit comprises:

a first eccentric shaft configured to transmit the rotation to the output cam; and a first connecting link configured to connect the first eccentric shaft with the output cam, wherein the first eccentric shaft is disposed in a first end of the first connecting link and engaged with an inner surface of the first end of the first connecting link.

3. The continuously variable valve lift apparatus of claim 2, wherein the first eccentric shaft and the first connecting link are disposed substantially within the output cam.

4. The continuously variable valve lift apparatus of claim 1, wherein the output cam driving unit comprises:

an input cam for transmitting the rotation to the output cam; and an input cam contact roller that is disposed at the output cam and contacts the input cam.

5. The continuously variable valve lift apparatus of claim 4, wherein the output cam driving unit includes an output cam elastic portion providing restoring force to the output cam toward the input cam to facilitate contact of the input cam contact roller with the input cam.

6. The continuously variable valve lift apparatus of claim 1, wherein the controlling unit comprises:

a second eccentric shaft configured to control the position of the controlling body; and a second connecting link connecting the second eccentric shaft with the controlling body, wherein the second eccentric shaft is disposed at a first end of the second connecting link and engaged with an inner surface of the first end of the second connecting link.

7. The continuously variable valve lift apparatus of claim 1, wherein the controlling unit comprises:

a controlling cam for controlling the position of the controlling body; and a controlling cam contact roller that is disposed to the controlling body and contacts the controlling cam.

8. The continuously variable valve lift apparatus of claim 7, wherein the controlling unit further comprises a controlling body elastic portion making restoring force to the controlling body toward the controlling cam to facilitate the controlling cam to contact the controlling cam contact roller.

9. The continuously variable valve lift apparatus of claim 1, wherein the guide portion comprises a plurality of guide rollers that contact at least a lateral surface of the controlling body.

10. The continuously variable valve lift apparatus of claim 9, wherein diameters of the guide rollers are different so as to compensate for position errors of the rollers.

11. The continuously variable valve lift apparatus of claim 10, wherein an upper shape of the valve opening unit that contacts the output cam and the lateral surface of the controlling body that contacts the guide rollers are concentric circles.

12. The continuously variable valve lift apparatus of claim 11, wherein the valve opening unit comprises a swing arm and a swing arm roller.

13. The continuously variable valve lift apparatus of claim 11, wherein the valve opening unit comprises a tappet having a crowning upper surface.

14. The continuously variable valve lift apparatus of claim 10, wherein the length of diameters of the concentric circles is infinite.

15. The continuously variable valve lift apparatus of claim 14, wherein the valve opening unit comprises a swing arm having a flat upper surface.

16. The continuously variable valve lift apparatus of claim 14, wherein the valve opening unit comprises a tappet having a flat upper surface.

17. An engine comprising the continuously variable valve lift apparatus of claim 1.

18. A passenger vehicle comprising the continuously variable valve lift apparatus of claim 1.

* * * * *